US009334086B2

(12) United States Patent
Bean et al.

(10) Patent No.: US 9,334,086 B2
(45) Date of Patent: May 10, 2016

(54) LOCKING SAMPLE CASE FOR HIGH VALUE AROMATIC MATERIALS

(71) Applicant: SB Ventures, INC., Vanocuver, WA (US)

(72) Inventors: James Bean, Portland, OR (US); Chol Pak, Camas, WA (US)

(73) Assignee: SB Ventures, INC., Vancouver, WA (US)

( * ) Notice: Subject to any disclaimer, the term of this patent is extended or adjusted under 35 U.S.C. 154(b) by 0 days.

(21) Appl. No.: 14/814,358

(22) Filed: Jul. 30, 2015

(65) Prior Publication Data

US 2016/0031605 A1 Feb. 4, 2016

Related U.S. Application Data

(60) Provisional application No. 62/031,020, filed on Jul. 30, 2014.

(51) Int. Cl.

| | |
|---|---|
| ***A45C 13/10*** | (2006.01) |
| ***B65D 25/54*** | (2006.01) |
| ***B65D 25/38*** | (2006.01) |
| ***B65D 85/00*** | (2006.01) |

(52) U.S. Cl.

CPC ..... *B65D 25/54* (2013.01); *B65D 25/38* (2013.01); *B65D 85/70* (2013.01)

(58) Field of Classification Search

CPC .... E05B 73/0023; A61L 9/03; A01M 1/2055; B65D 25/54; B65D 25/38; B65D 85/70

USPC ..... 206/1.5, 764, 765, 766, 769, 772, 773, 206/774, 775, 776, 777, 782, 457, 730, 731, 206/733, 734, 735, 732, 423; 239/34, 55, 239/57–59

See application file for complete search history.

(56) References Cited

U.S. PATENT DOCUMENTS

| | | | | | |
|---|---|---|---|---|---|
| 2,556,608 | A * | 6/1951 | Will | F24F 3/16 | 239/47 |
| 2,657,090 | A * | 10/1953 | Meek | B65D 85/00 | 131/231 |
| 2,765,194 | A * | 10/1956 | Will | A01M 1/2055 | 239/59 |
| 3,225,805 | A * | 12/1965 | Wise | A45C 3/00 | 150/100 |
| 3,995,396 | A * | 12/1976 | Spector | A01G 9/00 | 206/423 |
| 4,075,786 | A * | 2/1978 | van Zyl | B65D 85/52 | 206/423 |
| 4,135,331 | A * | 1/1979 | Lamlee | A01G 31/02 | 206/815 |
| 5,029,756 | A * | 7/1991 | Byrne | A61L 9/12 | 239/59 |
| 6,029,900 | A * | 2/2000 | Quinones | A61L 9/12 | 239/47 |
| 6,179,219 | B1 * | 1/2001 | Lin | A61L 9/12 | 222/500 |
| 6,237,788 | B1 * | 5/2001 | Shuen | A61L 9/12 | 206/457 |

(Continued)

*Primary Examiner* — Jacob K Ackun
*Assistant Examiner* — Jenine Pagan
(74) *Attorney, Agent, or Firm* — Rylander & Assoc. PC; Philip R. M. Hunt

(57) ABSTRACT

A locking sample case used for displaying high-valued aromatic materials. The sample case has a stage for holding the material, a cover configured to mate with the stage, and a base to mate with the mated stage and cover assembly. The base has a lock mechanism to lock the stage to the base. The cover has tabs that secure the cover to the stage. The sample case is configured so that when the stage is mated to the base, the tabs cannot disengage from the base, so the cover cannot be removed from the stage when the stage is mated with the base. The cover has windows and closable vents to allow a potential buyer to see and smell the aromatic material. The sample case is configured to have a tether that can only be detached when the base is decoupled from the stage.

13 Claims, 8 Drawing Sheets

(56) References Cited

U.S. PATENT DOCUMENTS 6,463,697 B2 * 10/2002 Weder ..... B65D 85/505 211/74
6,663,838 B1 * 12/2003 Soller ..... A01M 1/2088 422/120
7,597,308 B1 * 10/2009 Stucki ..... A01M 1/2033 222/187
7,938,262 B1 * 5/2011 Havive ..... B65D 7/20 206/423
2007/0051826 A1 * 3/2007 Schofield ..... A61L 9/03 239/60
2009/0166228 A1 * 7/2009 Kinunen ..... G09F 19/00 206/1.5
2010/0147844 A1 * 6/2010 Connell ..... A47G 7/06 220/62.18
2012/0318687 A1 * 12/2012 Martin ..... B65D 65/466 206/216

* cited by examiner

LOCKING SAMPLE CASE FOR HIGH VALUE AROMATIC MATERIALS

CROSS-REFERENCE TO RELATED APPLICATION

This application claims the benefit of U.S. Provisional Application No. 62/031,020, filed Jul. 30, 2015, incorporated herein by reference.

FIELD OF THE INVENTION

The present invention relates to display cases. More particularly, the present invention relates to display cases for high value aromatic materials.

BACKGROUND

Appearance and fragrance are important to retail customers of herbs and other fragrant materials. Consumers frequently desire to see and smell the aromatic materials they are considering purchasing. For common, low value materials, retailers may simply keep the fragrant materials in clear, air-tight jars and allow consumers to open the jars as they wish to smell the material's fragrance. However, with high value materials, this solution is undesirable as it is too easy for dishonest consumers to steal the materials while pretending to be merely smelling them.

What is needed is a secure display case that still allows consumers to see and smell high value herbs or other aromatic materials they are considering purchasing.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the invention and, together with the detailed description, serve to explain the principles and implementations of the invention.

DETAILED DESCRIPTION

Figure 1:
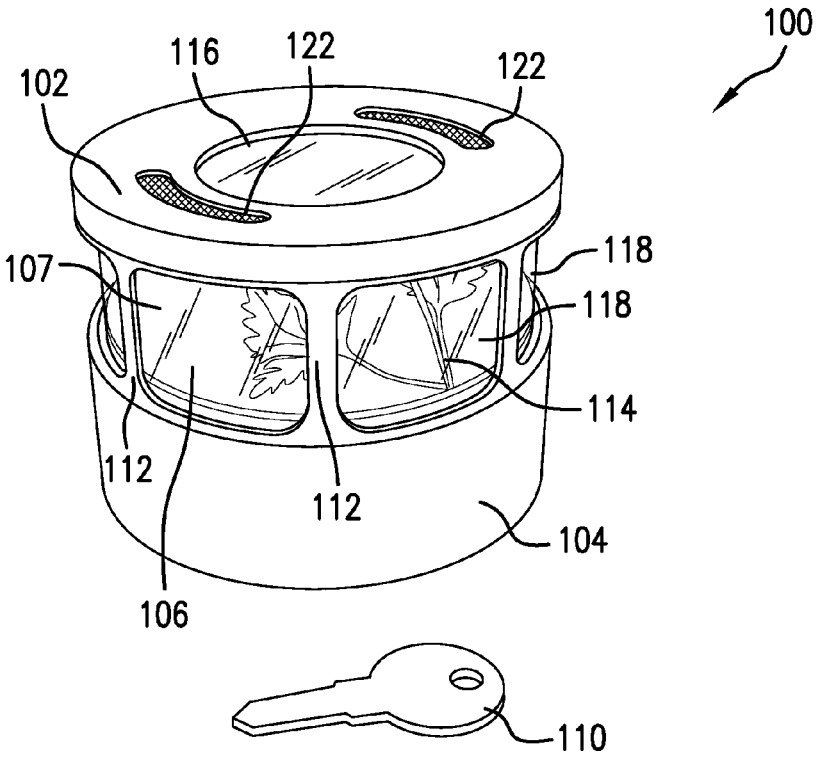
FIG. 1 shows a front perspective view of a first exemplary embodiment of a locking sample case for displaying high value herbs or other aromatic material.
Figure 2:
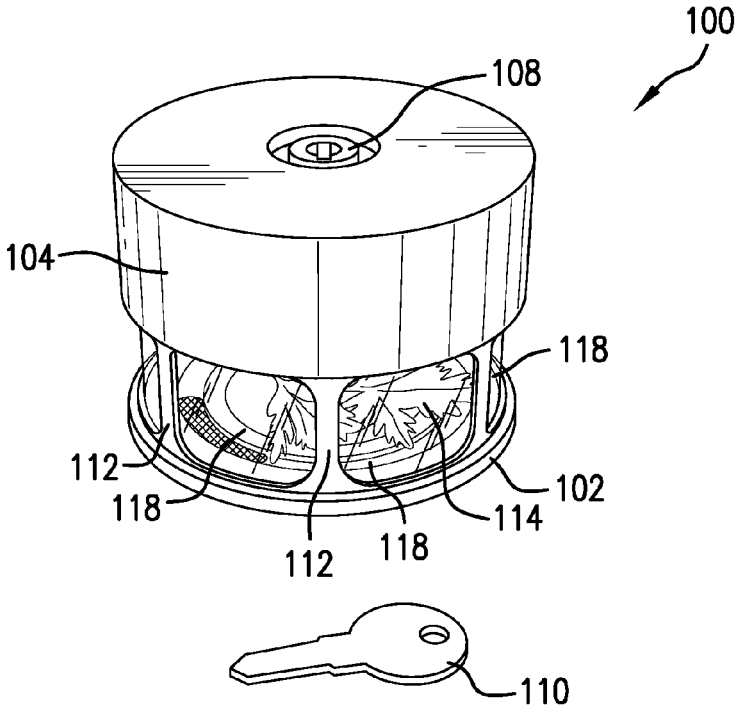
FIG. 2 shows a bottom perspective view of the first exemplary embodiment of the locking sample case.
Figure 3:
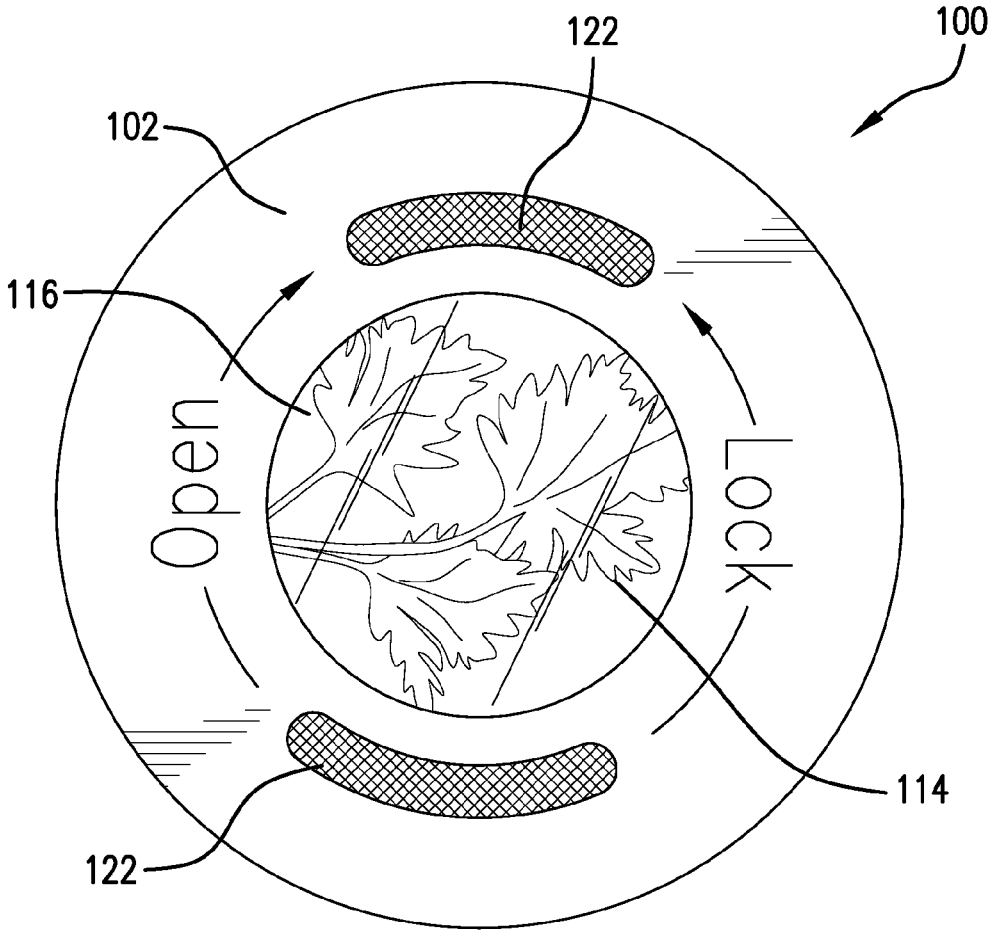
FIG. 3 shows a top view of the first exemplary embodiment of the locking sample case.

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

Those skilled in the art will recognize that numerous modifications and changes may be made to the exemplary embodiment(s) without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the exemplary embodiment(s) is essential. Other embodiments are possible, their specific designs depending upon the particular application. As such, the scope of the invention should not be limited by the particular embodiments herein described but should be defined only by the appended claims and equivalents thereof.

First Exemplary Embodiment

FIGS. 1-6 show various views of a first exemplary embodiment of a locking sample case for displaying high value herbs or other aromatic material. The first embodiment locking sample case 100 has a cover 102, a base 104 and a stage 106 that are configured to detachably couple together. In the first embodiment 100, the cover 102 and base 104 are cylindrical, but in other embodiments, may be configured with different shapes. The cover 102 is hollow, providing an interior space 107. The stage 106 is positioned inside the interior space 107 of the cover 102, providing a platform for displaying a sample material 114. The first embodiment locking sample case 100 has a lock mechanism 108 that allows a user to lock the cover 102 to the base 104 to restrict access to the sample material 114. See FIG. 2. The lock mechanism 108 is operated with a key 110, but in alternative embodiments, the lock mechanism 108 may be a combination lock.

The first embodiment locking sample case 100 is cylindrical in shape overall and the cover 102 and base 104 are cylindrical as well. However, in other embodiments, the locking sample case may have shapes other than cylindrical, such as cubical, and the cover 102 and base 104 may have other shapes as well.

The first embodiment locking sample case 100 has at least one top window 116 of transparent material in the cover 102. In the first embodiment 100, a portion of the transparent material in the top window 116 is shaped so that it acts as a magnifying lens. This allows a potential customer to view a magnified image of the sample material 114 and see small details that would not be as easily distinguished with the naked eye. In some alternative embodiments, the cover 102 does not have a magnifying portion of the top window 116.

The cover 102 has at least one side window 118 of transparent material. In the first embodiment locking sample case 100, the cover 102 has multiple side windows 118, separated by a plurality of pillars 112. In other embodiments, the cover 102 has a single side window 118 that wraps partially or all the way around the side of the cover 102.

The cover 102 has one or more vents 122. See FIG. 3. The vents 122 are holes penetrating into the interior space 107 of the cover 102. The vents 122 permit aromas from the sample material 114 to escape so a potential buyer can smell the herb aromas without opening the sample case 100. In the first embodiment 100, the vents are covered with a screen or mesh, to block all but the smallest particles of herb from escaping while allowing aromas to pass through. In some embodiments, the vents 122 have a mechanism for selectively opening and closing off the vents.

Figure 4:
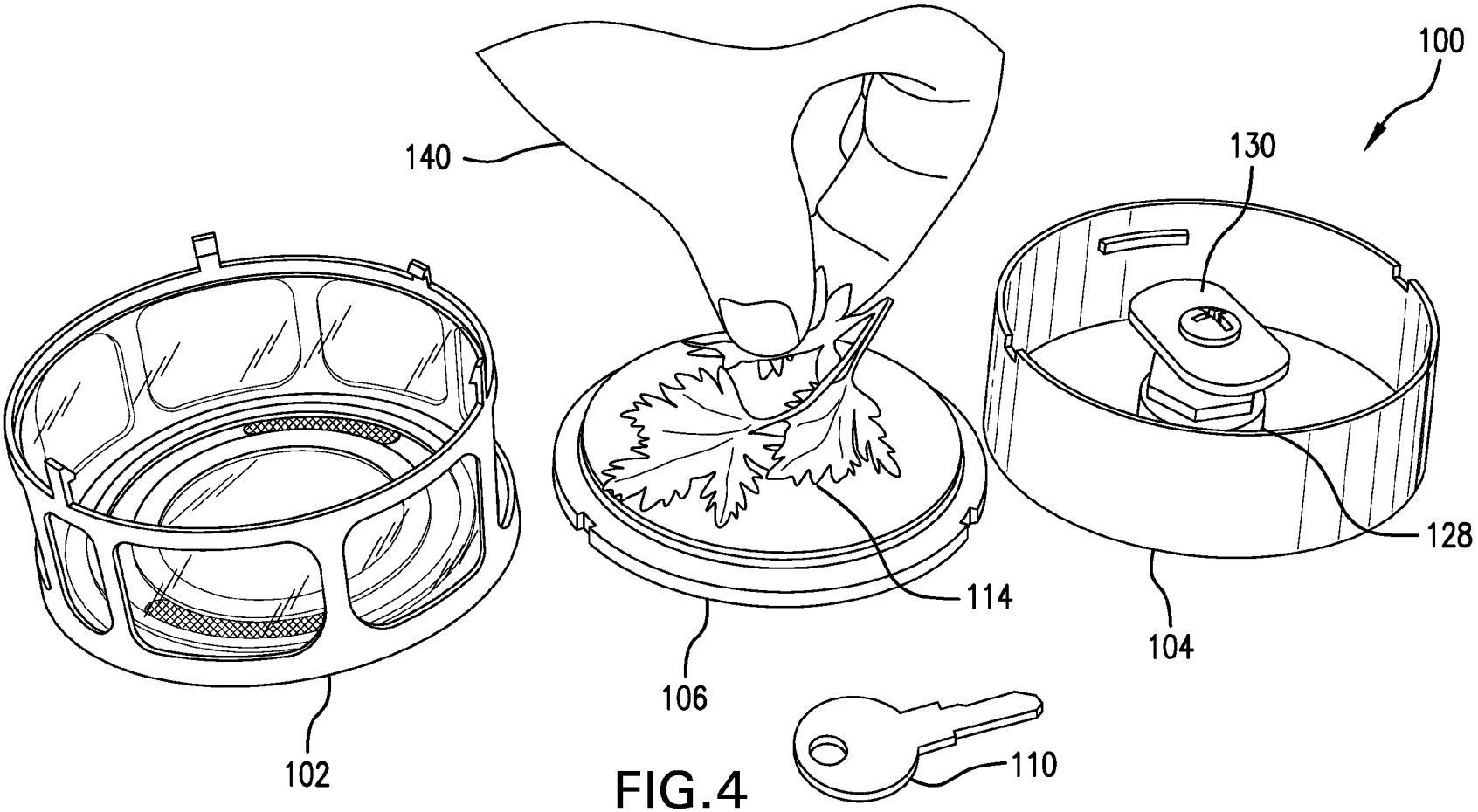
FIG. 4 shows a front perspective view of the first exemplary embodiment of the locking sample case disassembled with a user placing a sample material on the stage of the sample case.

FIG. 4 shows a perspective view of the first embodiment locking sample case 100 disassembled. The cover 102 has been decoupled from the base 104 and the stage 106 has been removed from inside the cover 102. In this disassembled configuration, a user 140 (typically a retail sales person) can add or remove the sample material 114 from the stage 106. The base 104 has a cavity therein. In the first embodiment locking sample case 100, the lock mechanism 108 is positioned within base 104, but in other embodiments may be in the cover 102 or comprise a separate component that locks together the cover 102 and base 104. The lock mechanism 108 comprises a lock cylinder 128 and a lock cross-bar 130. The key 110 may be inserted into the lock mechanism 108 from the bottom of the base 104 and when turned, will turn the lock cross-bar 130 within the cavity inside the base 104.

Figure 5:
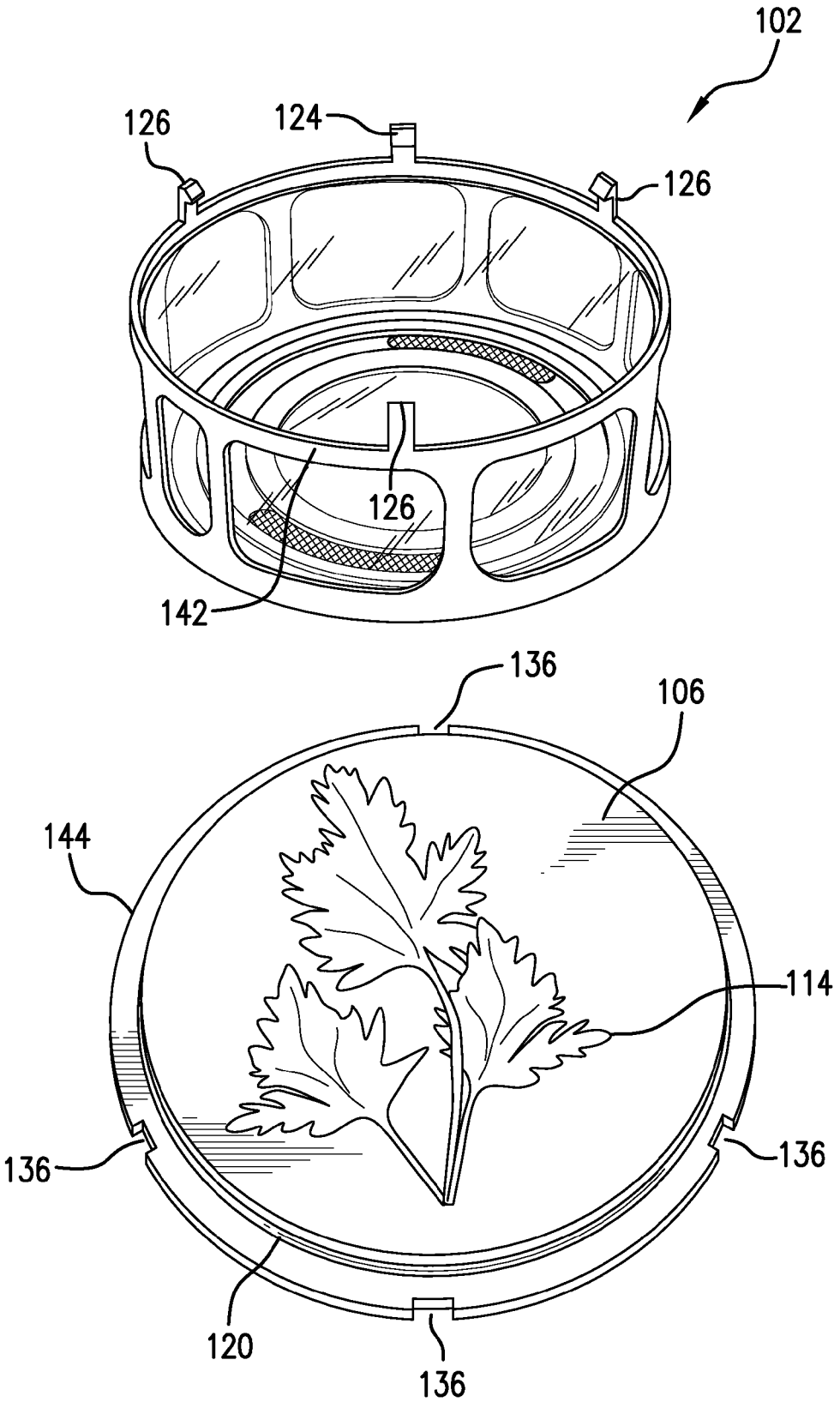
FIG. 5 shows a front perspective view of select parts of the disassembled first embodiment locking sample case, specifically the stage, inverted cover and showing a sample material on the stage.

FIG. 5 shows a front perspective view of the cover 102 and stage 106. The cover 102 has a plurality of tabs 124, 126 projecting downwards from a bottom edge 142 of the cover 102 (In FIG. 5, the cover 102 is inverted, so the tabs are shown projecting upwards). The tabs include at least two or more latching tabs 126 and may include one or more registration tabs 124. The tabs 124, 126 are shaped and positioned to each mate with one of a plurality of notches 136 in an edge 144 of the stage 106. The latching tabs 126 have distal ends that angle inward, typically 90 degrees or less, and are configured to hook on to the bottom of the stage edge 144 when the cover 102 is mated with the stage 106. The latching tabs 126 are flexible and can be pulled outward so their angled distal ends disengage for the stage 106 to be coupled or de-coupled from the cover 102.

The registration tabs 124 do not have a portion that angles inward and do not hook or grab hold of the stage 106. The registration tabs 124 serve to align the cover 102 with the stage 106 and the stage 106 with the base 104 when they are mated together. The base 104 has one or more base registration notch 148. When the assembly of the cover 102 and the stage 106 is coupled with the base 104, the assembly of the cover 102 and the stage 106 slides inside the base 104 and the one or more registration tabs 124 insert into the one or more base registration notches 148.

The stage 106 has an o-ring 120 near the stage edge 144. The stage o-ring 120 provides an air-tight seal between the stage 106 and the cover 102. When the vents 122 are closed, the interior space 107 of the cover 102 is closed off. This can help slow the rate at which the herb dries out or goes stale. It can also aid a potential buyer to focus on one sample material by only having the vents on one sample case open at a time.

Figure 6:
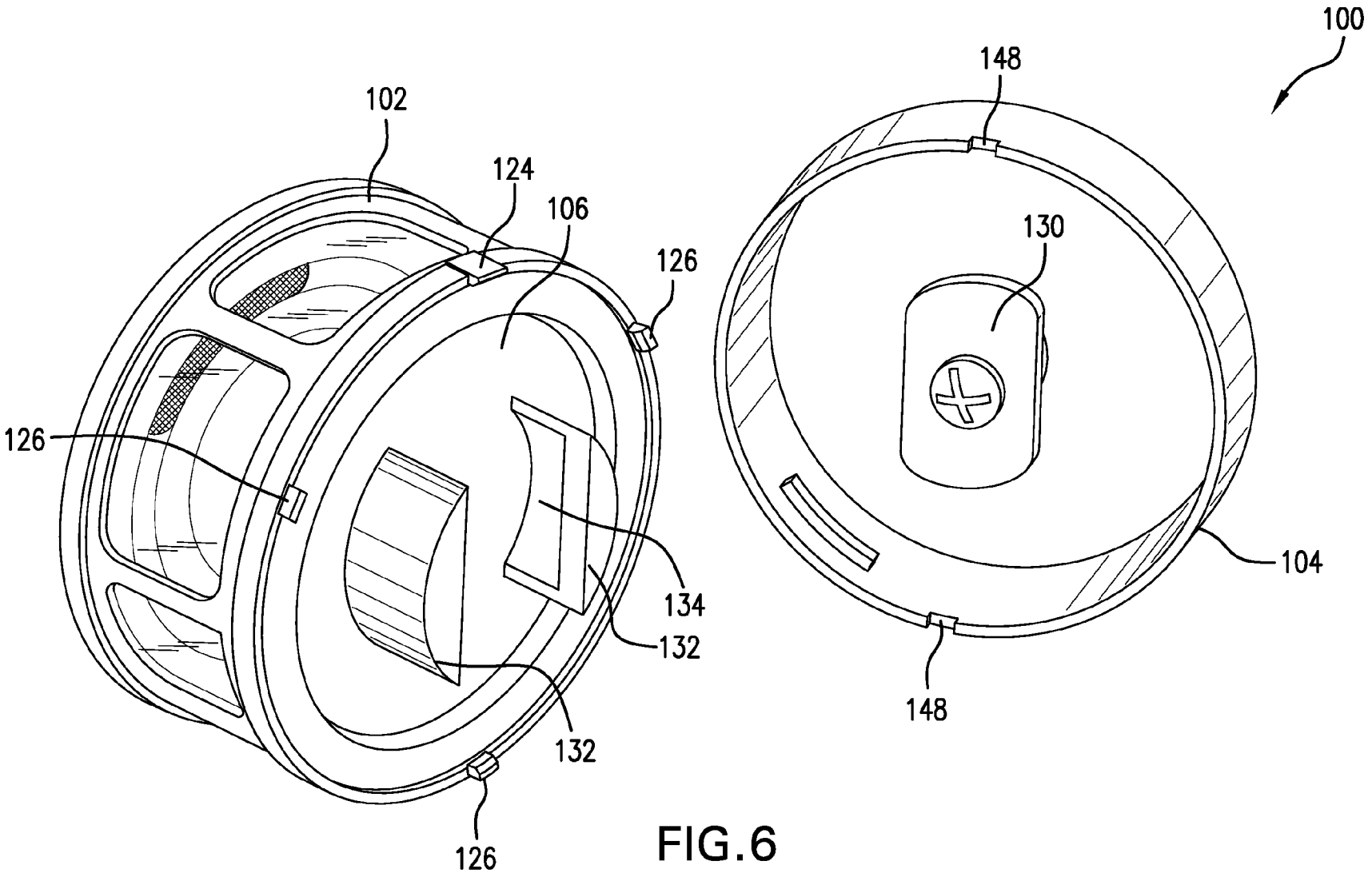
FIG. 6 shows a perspective view of the cover and stage mated together with the base close by in preparation for mating to the cover.

FIG. 6 shows a perspective view of the cover 102 and stage 106 mated together with the base 104 close by in preparation for mating to the cover 102. The inside diameter of the base 104 is slightly larger than the outside diameter of the stage 106. When the mated cover 102 and stage 106 are then mated with the base 104, the stage 106 and the latching tab 126 fit snugly inside the base 104. Once the cover 102 is mated with the base 104, the latching tabs 126 are blocked from being pulled out and disengaged from the stage 106. Thus as long as the mated cover 102 and stage 106 is mated to the base 104, the stage 106 cannot be non-destructively decoupled from the cover 102.

There are two brackets 132 on the bottom of the stage 106. The brackets 132 each have a portion that angles inward towards the other bracket 132, creating a bracket recess 134 between the stage 106 and the bracket 132. When the mated cover 102 and stage 106 are mated to the base 104 with the lock mechanism 108 in its open position, the lock cross-bar 130 fits into the space between the brackets 132. When the key 110 is turned, changing the lock mechanism 108 from its open position to its closed position, the lock cross-bar 130 rotates and its ends move into the bracket recess 134. The key 110 can then be withdrawn from the lock mechanism 108, after which the lock cross-bar 130 is held in position by the lock mechanism 108 and cannot rotate. With the ends of the lock cross-bar 130 in the bracket recesses 134, the mated cover 102 and stage 106 cannot be decoupled from the base 104 until the key 110 is re-inserted into the lock mechanism 108 and turned back to its open position.

Second Exemplary Embodiment

Figure 7:
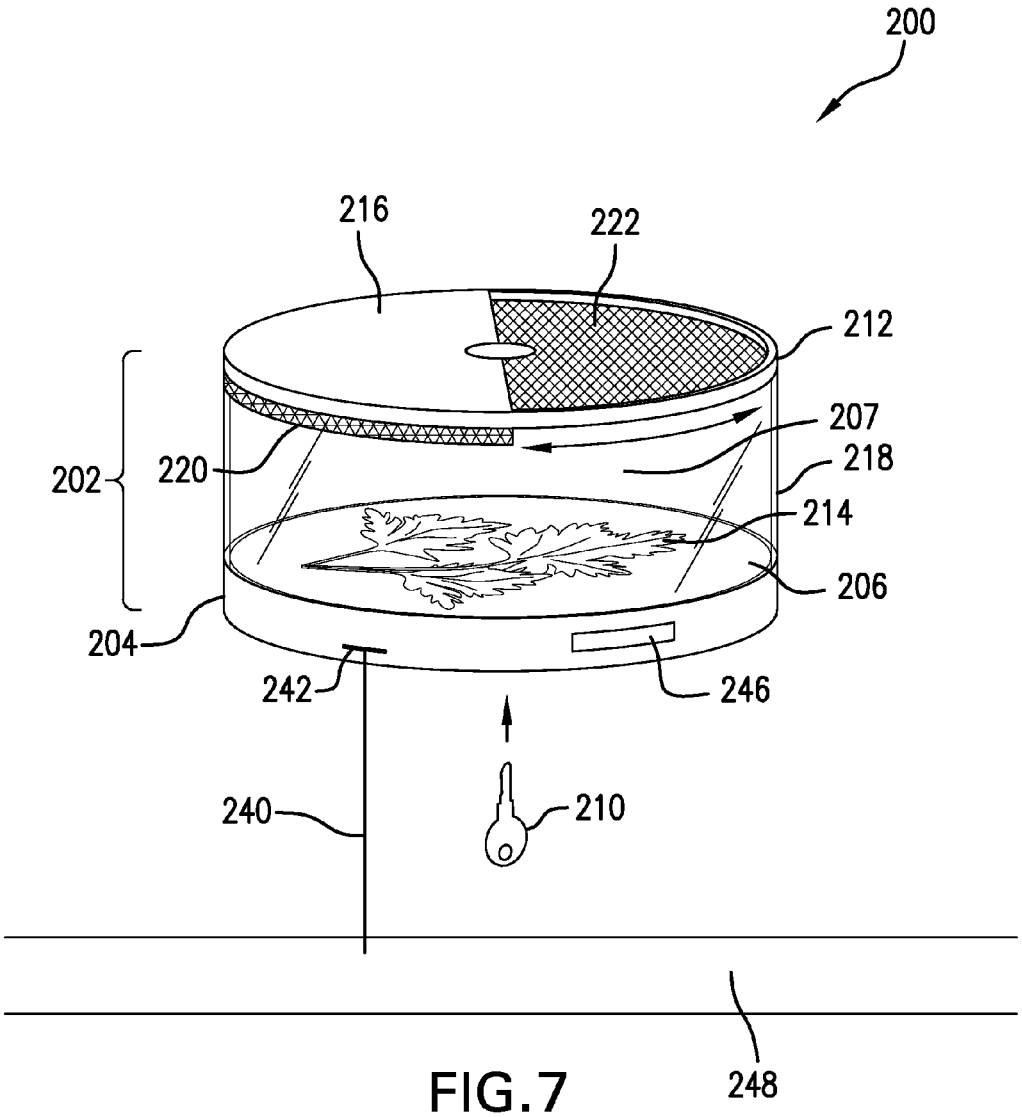
FIG. 7 shows a perspective view of a second embodiment of a locking sample case.

FIG. 7 shows a perspective view of a second embodiment of a locking sample case 200. Similar to the first embodiment 100, the second embodiment locking sample case 200 has a cover 202, a base 204 and a stage 260 which are configured for detachably coupling together. In the second embodiment 200, the cover 202 and base 204 are both cylindrical, but in other embodiments may have other shapes. The cover 202 has an interior space 207 into which a sample material 214 can be placed when the cover 202 is decoupled from the base 204. The second embodiment locking sample case 200 has a locking mechanism (not shown) similar to the one in the first embodiment 100 that prevents the cover 202 from decoupling from the base 204 without a key 210.

The cover 202 has cover cap 212 that is coupled to the rest of the cover 202 and is configured for rotating with respect to the rest of the cover 202. The cover cap 212 is configured so that as it rotates, the interior space 207 of the cover 202 is always enclosed by the cover 202 and base 204. For example, in the second embodiment 200, the cover cap 212 is circular in shape, but in other embodiments, the cover cap 212 may have a non-circular shape, but is larger in every lateral dimension than the diameter of the cover 202.

A top window 216 forms a portion of cover cap 212 and a vent 222 forms another portion of the cover cap 212. Under the cover cap 212 is a cover separator 220. The cover separator 220 is at least as large as the vent 222. The cover cap 212 is configured to rotate so that in a closed position, the entire vent 222 is over some portion of the cover separator 220. In the closed position, the interior space 207 of the cover 202 is closed off, preventing aromas from escaping and the sample material 214 from drying out. In the second embodiment 200, the vent 222 forms half of the cover cap 212 and the top window 216 forms the other half, but in other embodiments, the division may be different. For example, in another embodiment, the vent 222 may form one quarter of the cover cap 212 and the top window 216 form three quarters. In that embodiment, the cover separator 220 would be at least as large as one quarter of the cover cap 212. In yet other embodiments, the top window 216 and vent 222 may not form the entire cover cap 212 and another portion of the cover cap 212 is non-transparent and non-vented.

In the second embodiment 200, the top window 216 is made of transparent material, at least a portion of which is shaped into a magnifying lens. In other embodiments, the magnifying lens may be absent and the top window 216 is transparent, but unmagnified.

The cover 202 has a side window 218 that forms all or at least a portion of the side of the cover 202. The side window 218 is comprised of a transparent material, such as acrylic glass or polycarbonate. In the second embodiment 200, the side window 218 completely encircles the side of the cover 202, but in alternative embodiments, may be intervened by pillars, such as in the first embodiment 100.

In the second embodiment 200, the cover 202 and the base 204 are configured for detachably coupling by snapping together, but in other embodiments may be configured for detachably coupling by some other method such as screwing together.

The second embodiment locking sample case 200 has an RFID tag 246 that is embedded in the base 204 or attached thereon. The RFID tag 246 serves as part of an anti-theft system. Detectors at exits to a store can detect if the RFID tag 246 passes through the exit. In other embodiments, the RFID tag 246 is attached or embedded in other parts of the locking sample case, such as the stage 206 or cover 202.

The second embodiment locking sample case 200 has a tether 240 attaching to a tether attachment point 242. The tether attachment point 242 is embedded in or attached to the base 204, but in other embodiments may be embedded in or attached to the cover 202. The tether 240 serves as an anti-theft feature, with the other end of the tether 240 secured to a difficult to move object, such as a table 248.

Third Exemplary Embodiment

Figure 8:
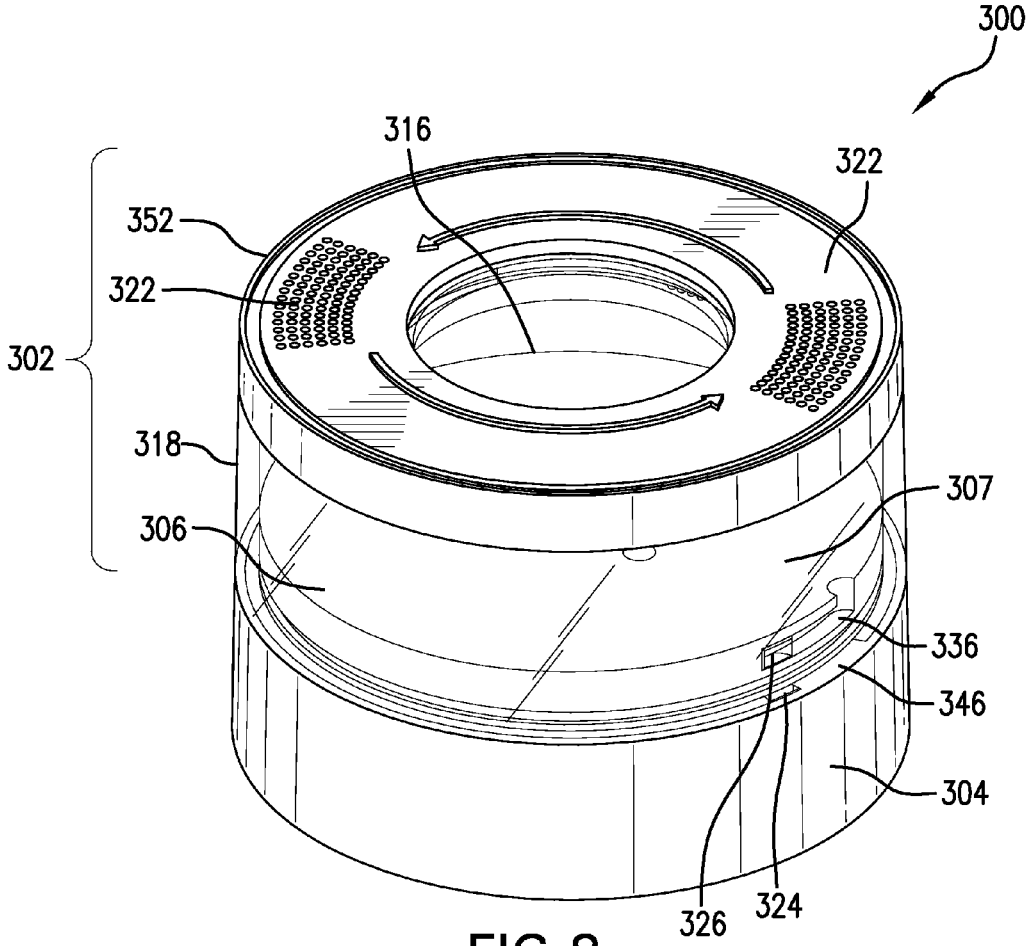
FIG. 8 shows a perspective view of a third embodiment of a locking sample case.
Figure 9:
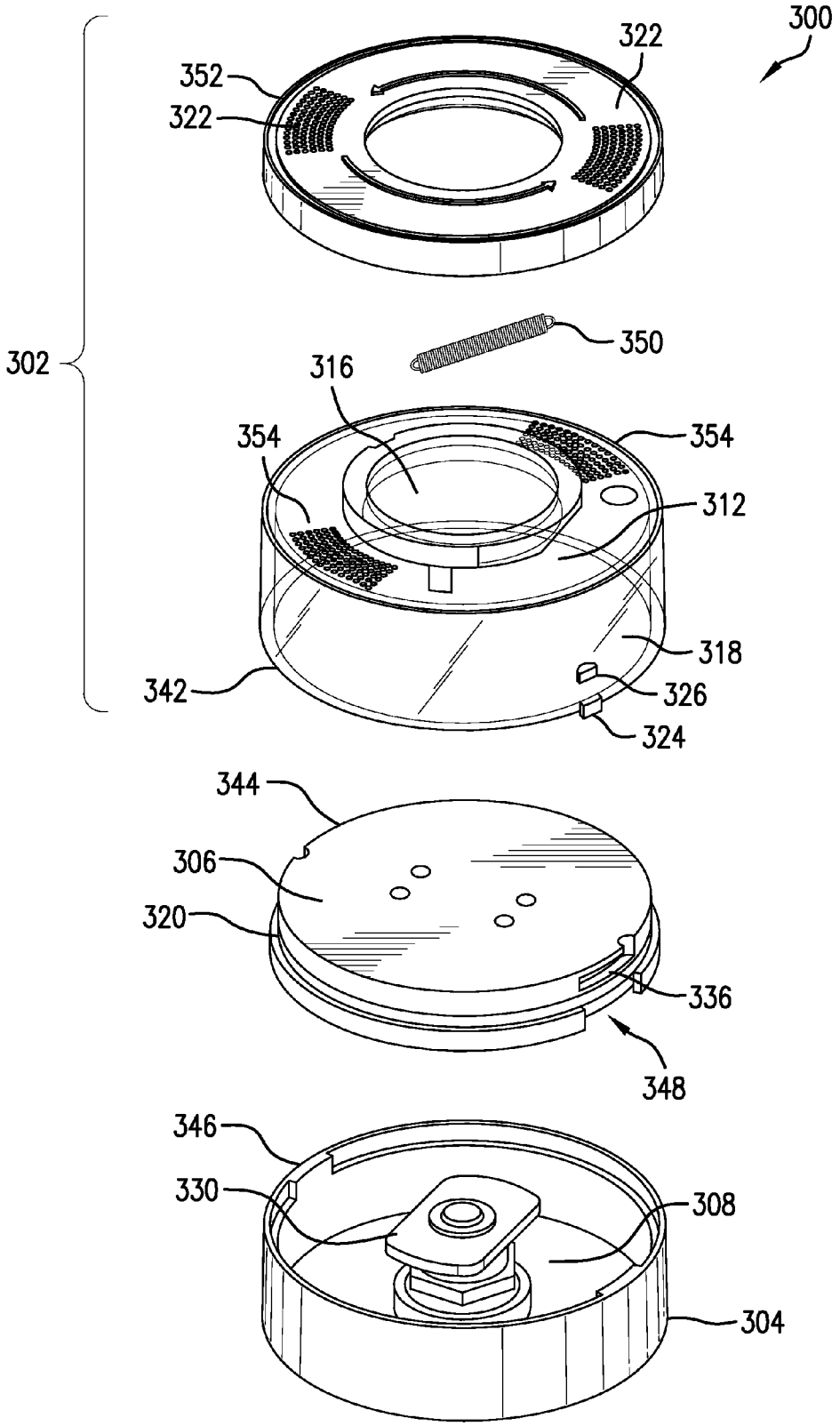
FIG. 9 shows an exploded perspective view of the third embodiment locking sample case.

FIGS. 8 and 9 show a third exemplary embodiment of a locking sample case 300. FIG. 8 shows a perspective view of the third embodiment locking sample case 300. FIG. 9 shows an exploded perspective view of the third embodiment locking sample case 300. The third embodiment locking sample case 300 is similar to the first embodiment locking sample case 100, and most components are similar and have similar function. The third embodiment locking sample case 300 has a cover 302, a base 304 and a stage 306. Similar to the first embodiment locking sample case 100, the cover 302 in the third embodiment locking sample case 300 is hollow, providing an interior space 307. The third embodiment locking sample case 300 has a lock mechanism 308 that allows a user to lock the cover 302 to the base 304.

The third embodiment locking sample case 300 has some differences from the first embodiment locking sample case 100. In particular, the cover 302 has a cover top 312 and a side window 318 that wraps around the cover top 312. Both the side window 318 and cover top 312 are transparent, but in alternative embodiments, some or all of the side window 318 and/or cover top 312 are not transparent. The cover top 312 has a top window 316 and two cover cap vents 354. The cover 302 has a cover ring 352 coupled to the cover top 312 in a manner that allows it to rotate on a common axis with the cover top 312. The cover ring 352 has two cover ring vents 322. The cover ring 352 is configured to rotate to an open position where cover ring vents 322 align with the cover cap vents 354 and rotate to a closed position where the cover ring vents 322 do not align with the cover cap vents 354. When in the open position, aromas within the interior space 307 can diffuse out. The cover 302 has a spring 350 coupled to the cover ring 352 and the cover top 312 configured to exert a force when the cover ring 352 is not in the closed position that will tend to rotate the cover ring 352 back to the closed position.

The stage 306 has a stage o-ring 320 near the stage edge 344. The stage o-ring 320 provides an air-tight seal between the stage 306 and the cover 302. When the cover ring vents 322 are in the closed position, the interior space 307 of the cover 302 is closed off. This can help slow the rate at which the herb dries out or goes stale. It can also aid a potential buyer to focus on one sample material by only having the vents on one sample case open at a time.

The cover 302 has a plurality of cover registration tabs 324 projecting downwards from a bottom edge of the cover 302. The cover registration tabs 324 are each shaped and positioned to insert into one of a plurality of stage registration notches 348 in an edge 344 of the stage 306. The cover 302 also has one or more cover latching tabs 326 that are configured to hook into L-shaped stage latching grooves 336 in the stage edge 344 when the cover 302 is mated with the stage 306. Rotating the cover 302 relative to the stage 306 locks the cover 302 onto the stage 306.

The base 304 has a plurality of base registration tabs 346 that are shaped and positioned to insert into the stage registration notches 348 when the mated cover 302 and stage 306 are then mated with the base 304. Each base registration tab 346 shares its stage registration notch 348 with one of the cover registration tabs 324. This prevents the cover 302 from rotating relative to the stage 306, which in turn prevents the cover latching tabs 326 from rotating into the vertical part of the stage latching grooves 336, preventing the cover 302 from decoupling from the stage 306.

There are two brackets (not shown, but similar to brackets 132 in the first embodiment locking sample case 100) on the bottom of the stage 306 creating a bracket recess between the stage 306 and the bracket. When the mated cover 302 and stage 306 are mated to the base 304 with the lock mechanism 308 in its open position, a lock cross-bar 330 fits into the space between the brackets. When the lock mechanism 308 is changed from its open position to its closed position, the lock cross-bar 330 rotates and its ends move and engage the brackets. With the ends of the lock cross-bar 330 in the bracket recesses, the mated cover 302 and stage 306 cannot be decoupled from the base 304 until the lock mechanism 308 is turned back to its open position.

What is claimed is:

1. A device for displaying high-valued aromatic materials comprising:

a stage;

a cover with a transparent window, a cover vent and a plurality of latching tabs configured for detachably coupling the cover with the stage;

a base configured for detachably coupling with the stage, the base having a lock mechanism configured for preventing decoupling of the stage from the base when the lock mechanism is in a locked configuration; and wherein the device is configured such that when the cover is coupled with the stage and the stage is coupled with the base, the latching tabs are prevented from decoupling from the stage.

2. The device of claim 1, wherein the cover further comprises a cover cap configured for rotating with respect to a rest of the cover; and wherein a first portion of the cover cap is the transparent window and a second portion of the cover cap is the cover vent.

3. The device of claim 1, wherein the cover further comprises a cover top and a cover ring coupled to the cover top such that the cover ring may be rotated relative to the cover top;

wherein a first portion of the cover top is the transparent window and a second portion of the cover top is a cover cap vent, part of the cover vent;

wherein the cover ring has an open center positioned over the transparent window of the cover top;

wherein the cover ring has a cover ring vent, part of the cover vent;

wherein the cover ring is configured to rotate to an open position where cover ring vent aligns with the cover cap vent and configured rotate to a closed position where the cover ring vent does not align with the cover cap vent; and wherein the cover further comprises a spring coupled to the cover ring and to the cover top, the spring configured to exert a force when the cover ring is not in the closed position, the force acting to rotate the cover ring back to the closed position.

4. The device of claim 1, wherein the plurality of latching tabs each have a distal end that angles inward and is configured to hook on to a bottom edge of the stage when the cover is coupled with the stage.

5. The device of claim 4, wherein the plurality of latching tabs are flexible and configured to be pulled outward to disengage the distal ends from the bottom edge of the stage.

6. The device of claim 4, wherein the device is configured such that when the cover and stage are coupled and the stage is coupled to the base, then the latching tabs fit snugly inside the base, the base preventing the latching tabs from being pulled outward and disengaged from the stage.

7. The device of claim 1, wherein the stage has a plurality of latching grooves, each L-shaped with a corner; and wherein the device is configured for coupling the cover to the stage by each of the plurality of latching entering into one of the latching grooves until encountering the corner of the latching groove, then traversing laterally beyond the corner of the latching groove while the stage is rotated relative to the stage.

8. The device of claim 7, wherein the stage has a stage registration notch;

wherein the cover has a cover registration tab;

wherein the base has a base registration tab; and wherein the device is configured for coupling the base to the stage and the cover by the cover registration tab and the base registration tab inserting into the stage registration notch while the latching tabs are positioned in the latching grooves laterally beyond the corner of the latching groove.

9. The device of claim 8, wherein the device is configured such that such that when the cover and stage are coupled and the stage is coupled to the base, then the base registration tab blocks the cover registration tab from moving laterally, preventing the latching tabs from moving within the latching grooves to the corners of the latching grooves.

10. The device of claim 1, further comprising a detachable tether; and wherein the device is configured such that the detachable tether cannot be detached if the locked mechanism is in a locked configuration.

11. The device of claim 1, where in the transparent window comprises a magnifying lens.

12. The device of claim 1, where in the transparent window comprises polycarbonate.

13. The device of claim 1, where in the cover comprises polycarbonate.

* * * * *